United States Patent [19]

Bondy

[11] Patent Number: 4,665,301

[45] Date of Patent: May 12, 1987

[54] HEATED INSERT FOR BOOTS

[76] Inventor: Larry Bondy, 370 Caroline, Hubbard, Ohio 44425

[21] Appl. No.: 792,101

[22] Filed: Oct. 28, 1985

[51] Int. Cl.[4] ..... H05B 3/34

[52] U.S. Cl. ..... 219/211; 219/527; 219/549

[58] Field of Search ..... 219/211, 212, 527, 528, 219/529, 548, 549, 200, 201

[56] References Cited

U.S. PATENT DOCUMENTS

| | | | |
|---|---|---|---|
| 1,566,987 | 12/1925 | Simmons | 219/211 |
| 1,706,385 | 3/1929 | Graf | 219/211 |
| 2,025,950 | 12/1935 | Kurtz | 219/211 |
| 2,028,347 | 1/1936 | Pelosi | 219/211 |
| 2,458,119 | 1/1949 | Van Daam | 219/211 |
| 2,633,846 | 4/1953 | Wray | 219/211 |
| 2,692,326 | 10/1954 | Crowell | 219/211 |
| 3,360,633 | 12/1967 | Weisberger | 219/211 |
| 3,751,620 | 8/1973 | Yuasa | 219/211 |
| 3,867,611 | 2/1975 | Riley | 219/211 |
| 3,906,185 | 9/1975 | Gross | 219/211 |
| 3,946,193 | 3/1976 | Giese | 219/211 |

FOREIGN PATENT DOCUMENTS

| | | | |
|---|---|---|---|
| 660224 | 6/1935 | Fed. Rep. of Germany | 219/211 |
| 556300 | 2/1957 | Italy | 219/528 |

*Primary Examiner*—E. A. Goldberg
*Assistant Examiner*—Teresa J. Walberg
*Attorney, Agent, or Firm*—Harpman & Harpman

[57] ABSTRACT

An electrically heated insert for boots and the like that can be fitted into any size footwear to provide long-term warmth to the feet. The insert is of a multiple layer configuration having a heating element within that is connected to an external battery.

3 Claims, 4 Drawing Figures

HEATED INSERT FOR BOOTS

BACKGROUND OF THE INVENTION

1. Technical Field

This invention relates to devices used to keep individual's feet warm during long outdoor activities such as hunting. Electric resistant heating wires are used to generate heat from a portable electric source.

2. Description of Prior Art

Prior art devices of this type have relied on a variety of different designs attempting to heat footwear by electric resistant cells. See for example U.S. Pat. No. 3,906,185, U.S. Pat. No. 3,360,633 and U.S. Pat. No. 2,692,326.

In U.S. Pat. No. 2,692,326, a heated shoe is disclosed having a heating element within the sole of the shoe. Vent openings are provided in the upper sole portion to allow heat to pass upward from the interior of the shoe.

U.S. Pat. No. 3,360,633 discloses a portable heating apparatus having a platform in which is contained batteries and a heating resistant film. A strap is used to secure the platform to the foot of the wearer with the heating film positioned on the concave platform support portion.

In U.S. Pat. No. 3,960,185 a heated insole construction is shown having a layer of plastic mesh material with an overlying plastic mat with an electrically conductive circuit printed thereon. A cloth layer covers the conductive circuit material.

SUMMARY OF THE INVENTION

An electrically heated insert for footwear to provide safe reliable even heat to the user's feet when exposed to cold weather for a long duration of time. The insert is of a multiple configuration that is fitted by trimming to the desired size and has a heat sink structure to distribute heat and protect an electrical resistant coil within. The insert is powered by an external battery for portable use.

DESCRIPTION OF THE PREFERRED EMBODIMENT

Figure 1:
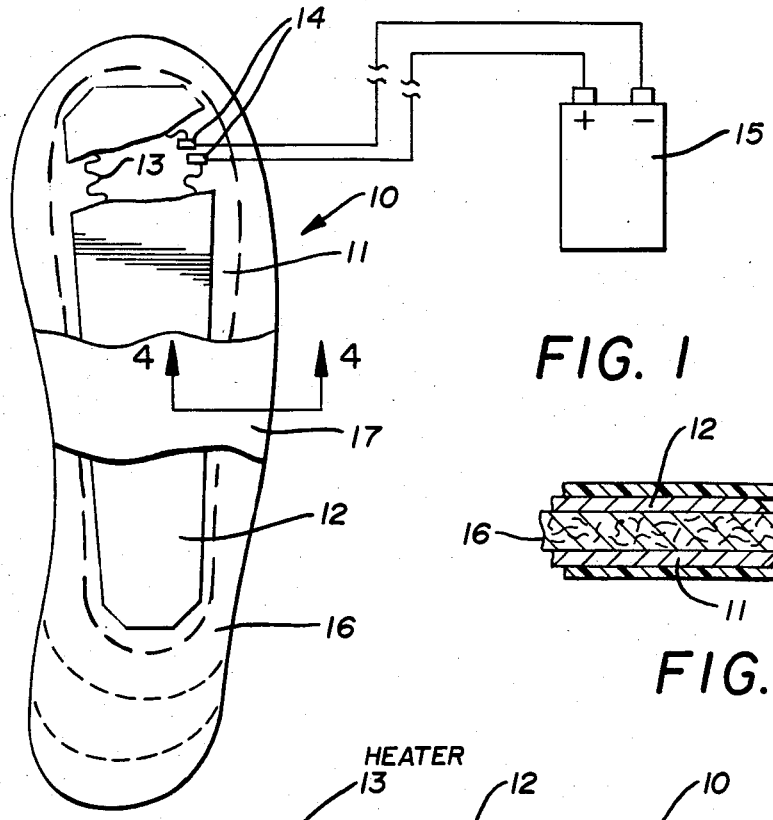
FIG. 1 is a top plan view of a heated insert with portions cut away.
Figure 2:
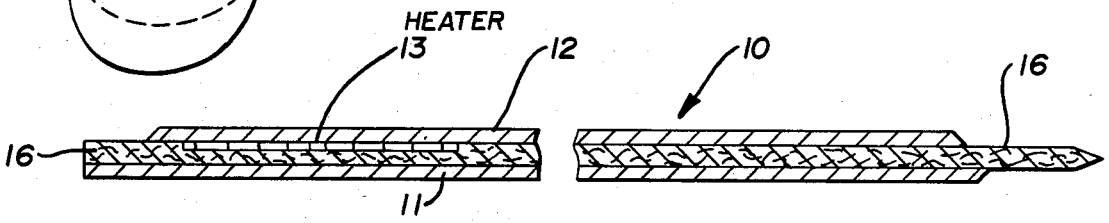
FIG. 2 is a cross sectional view of the heated insert of FIG. 1.
Figure 3:
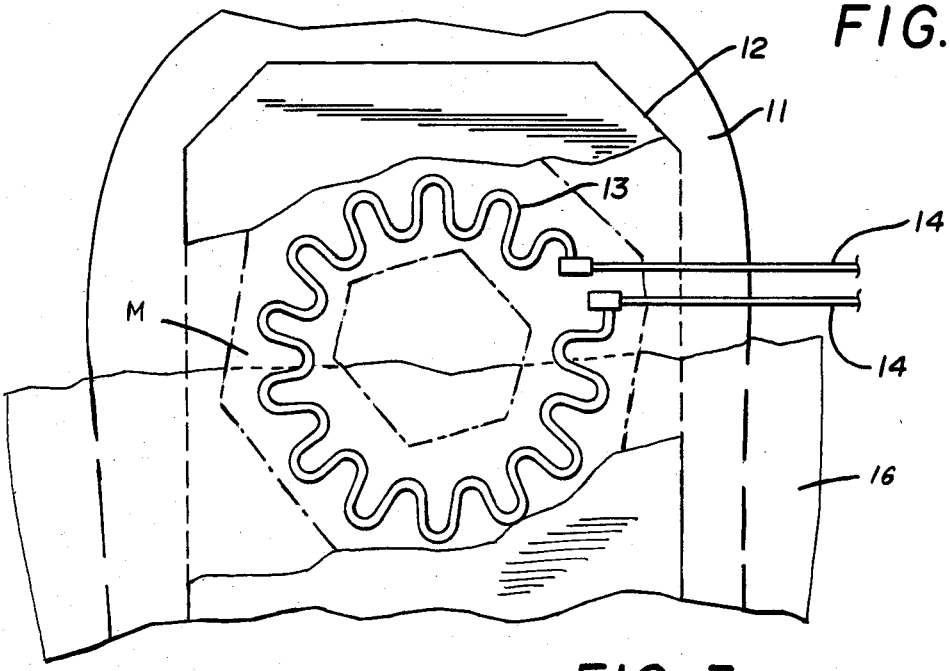

A heating insert 10 can be seen in FIGS. 1 and 2 of the drawings having a multiple layer construction comprising of a pair of flat thin contoured plates 11 and 12 in spaced relation to one another. Each of the contoured plates, 11 and 12, has a generally elongated configuration with a length greater than its width. The plate 11 has a slightly larger surface area than plate 12 which is of a material having the characteristics of good heat transfer and dispursion such as copper. A flattened coil configuration of electrically conductive wire 13 best seen in FIG. 3 of the drawings is arranged in a generally circular pattern adjacent one surface of the copper plate 12 at one end thereof encompassing approximately one-quarter of the surface of the plate. The wire 13 has a proportionally high electrically resistance factor which when conducting an electrical current generates heat as is well known and well understood in the art.

A pair of electrical leads 14 are secured to and extend from the opposite ends of the wire 13 to a portable power source 15. A contoured leather cushion 16 is positioned between the plates 11 and 12 spacing the same and extending outwardly therefrom as best seen in FIG. 1 of the drawings. The conductive wire 13 is secured to the leather cushion 16 by an adhesive-backed electrically resistant material M having good heat performance properties so that the conductive wire 13 will not directly touch the plate 12 and yet provide adequate transfer of the maximum heat to the plate.

The leather cushion 16 defines the overall shape of the heating insert 10 and cushions the plates 11 and 12 which are self-seating within the leather cushion after limited use. A plasticized cover material 17 extends over and covers entirely the hereinbefore described structure on both sides sealing same within. The covering material 17 is wear-resistant and is secured by adhesive in this example chosen for illustration.

Figure 4:
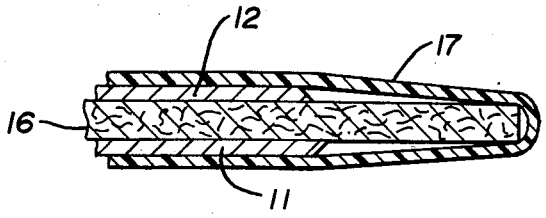
FIG. 3 is an enlarged top plan of a portion of the heated insert with the heating resistant coil positioned within and FIG. 4 is a section on lines 4—4 of FIG. 1.

Referring now to FIG. 4 of the drawings, a partial transverse section of the heating insert 10 can be seen illustrating the overlapping arrangement of the layered configuration of plates 11 and 12, a leather cushion 16 therebetween and the protective covering material 17.

It will be evident from the above description that as the wire 13 is supplied current from the power source it will heat the copper plate 12 which acts as a heat sink obsorbing the heat and transferring same over the length of the plate. The leather cushion 16 acts not only as a spacer and seat for the plates but also as an effective insulator between the plates. The thin plasticized material 17 affects an efficient heat transfer to the wearer's feet to provide a constant overall warmth thereto. Since the plate 12 is of a copper material positioned on the leather cushion 16 the heat is retained affording the user a constant warmth even during intermittent supply of electrical energy to the wire 13 thus increasing the affective life of the power source which is critical in a self-contained portable device of this type.

For initial use of the heat insert into a boot for example (not illustrated) the leather cushion 16 and associated cover material 17 can be trimmed to fit the footwear in which the heating insert is to be used as is suggested by the dotted lines in FIG. 1 of the drawings.

Thus it will be seen that a new and useful device has been illustrated and described and that various changes and modifications may be made here and without departing from the spirit of the invention.

Therefore, I claim:

1. An electrical heat insert for boots and the like comprising a pair of contoured plates a resilient deformable material positioned between and extending outwardly from said plates, a heating coil secured between one of said plates and said resilient deformable material, electric conductive lines extending from said heating coil to a power source, a cover material encapsulating said plates, the heating coil and the resilient deformable material positioned therebetween sealing same in to one intrical unit.

2. The electrical heating insert for boots and the like of claim 1 wherein said heating coil is electrically insulated from one of said plates and thermally insulated from the other of said plates.

3. The electrical heating insert for boots and the like of claim 1 wherein said power source comprises a battery with means for selectively connecting said battery to said heating coil.

* * * * *